US012012266B2

(12) United States Patent
Kinoshita et al.

(10) Patent No.: US 12,012,266 B2
(45) Date of Patent: Jun. 18, 2024

(54) EJECTION CAP

(71) Applicant: SHISEIDO COMPANY, LTD., Tokyo (JP)

(72) Inventors: Megumi Kinoshita, Tokyo (JP); Toshifumi Yoshida, Tokyo (JP); Jun Ishii, Tokyo (JP); Masahiko Nagoshi, Tokyo (JP); Takako Onishi, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 0 days.

(21) Appl. No.: 17/766,683

(22) PCT Filed: Oct. 9, 2020

(86) PCT No.: PCT/JP2020/038294
§ 371 (c)(1),
(2) Date: Apr. 5, 2022

(87) PCT Pub. No.: WO2021/075374
PCT Pub. Date: Apr. 22, 2021

(65) Prior Publication Data

US 2024/0043187 A1 Feb. 8, 2024

(30) Foreign Application Priority Data

Oct. 15, 2019 (JP) ..... 2019-188366

(51) Int. Cl.
*B65D 51/22* (2006.01)
*B65D 41/04* (2006.01)
*B65D 47/06* (2006.01)

(52) U.S. Cl.
CPC ..... *B65D 51/222* (2013.01); *B65D 41/04* (2013.01); *B65D 47/06* (2013.01)

(58) Field of Classification Search
CPC .... B65D 51/222; B65D 51/221; B65D 51/22; B65D 51/20; B65D 51/2835; B65D 41/04; B65D 47/06
(Continued)

(56) References Cited

U.S. PATENT DOCUMENTS

2002/0179605 A1* 12/2002 Miani ..... B65D 5/748 220/277

FOREIGN PATENT DOCUMENTS

CN 101500904 A 8/2009
DE 102010040825 A1 * 3/2012 ..... B05B 1/22
(Continued)

OTHER PUBLICATIONS

International Search Report (ISR) dated Dec. 1, 2020 filed in PCT/JP2020/038294.
(Continued)

*Primary Examiner* — Robert J Hicks
(74) *Attorney, Agent, or Firm* — RANKIN, HILL & CLARK LLP

(57) ABSTRACT

Provided is an ejection cap capable of smoothly and reliably breaking through a film closing a mouth part of a container body and ejecting a content inside a container.
An ejection cap (1) comprising an asymmetric cutter (6) that hangs from a lower surface of a top plate part of a substantially cylindrical dispensing cylinder (4) threadedly engaging a mouth part (3*a*) of a container body (3) closed by a film (2) and penetrating the film to eject a content, and that has a notch part (7) at a lateral surface on a side opposite to a threadedly engaging rotating direction on a substantially circumference at the tip of the dispensing cylinder.

3 Claims, 6 Drawing Sheets

(58) Field of Classification Search
USPC ... 220/258.4, 258.3, 258.1, 256.1, 278, 277, 220/265; 215/329, 228, 44, 297, 296; 222/91, 89, 81, 80
See application file for complete search history.

(56) References Cited

FOREIGN PATENT DOCUMENTS

| | | | | |
|---|---|---|---|---|
| EP | 2055640 | A1 * | 5/2009 | ..... B65B 69/00 |
| JP | 10-230960 | A | 9/1998 | |
| JP | 3978224 | B1 | 9/2007 | |
| JP | 2012-51650 | A | 3/2012 | |
| JP | 2017-165706 | A | 9/2017 | |

OTHER PUBLICATIONS

Chinese Office Action dated Oct. 30, 2023 issued in Chinese Patent Application No. 202080070453.5 and its English machine translation.

* cited by examiner

FIG. 2

| | Example1 | Example2 | Comparative Example 1 | Comparative Example 2 |
|---|---|---|---|---|
| Number of cutters | 1 | 2 | 1 | 1 |
| Position(s) of cutout(s) | Side surface opposite to direction of rotation for threadedly engaging | Side surface opposite to direction of rotation for threadedly engaging | No cutouts | Side surface in direction of rotation for threadedly engaging |
| Elevation view and side view | 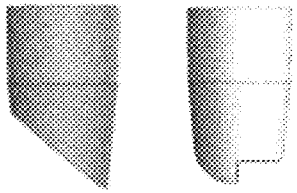 | 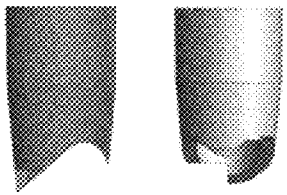 | 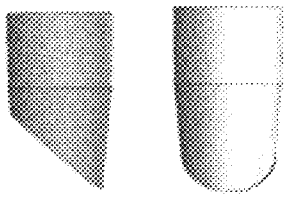 | 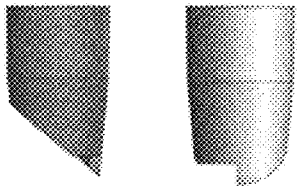 |
| Film perforability | ○ | ◎ | × | × |
| Rotational torque | ○ | ○ | ○ | × |
| Comprehensive evaluation | ○ | ◎ | × | × |

FIG. 3
| | | 【Test Example1】 | 【Test Example2】 | 【Test Example3】 | | 【Test Example4】 |
|---|---|---|---|---|---|---|
| Number of cutters | | 2 | 2 | 3 | | 2 |
| Sub cutter | Relative angle to main cutter | 180° | 180° | 90° | 180° | 120° |
| | Relative height difference to main cutter | 1.27mm | 0 mm | 0.64mm | 1.28mm | 0.425mm |
| External view | | 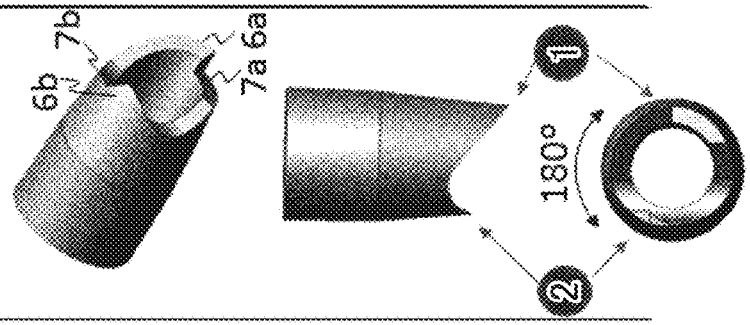 | 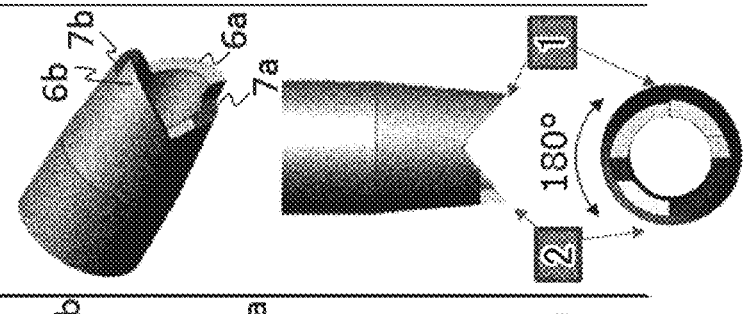 | 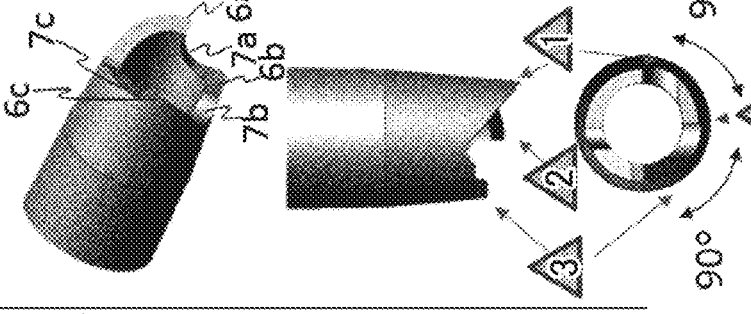 | | 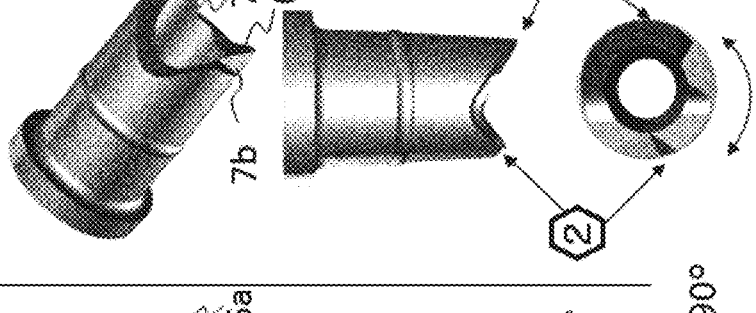 |

EJECTION CAP

TECHNICAL FIELD

The present invention relates to an ejection cap that threadedly engages with a mouth part of a container body and breaks through a film that closes the mouth part to allow a content of a container to be dispensed.

BACKGROUND ART

Conventionally, a container such as a bottle or a tube containing a drug, cosmetic, or the like has a film attached to a mouth part of a container body to seal the contents, and when the container is to be used, a cap is screwed onto the mouth part of the container body. A tip of a dispensing cylinder that extends from a lower surface of a top plate of the cap breaks through the film to allow the contents to be dispensed (Patent Document 1). These ejection caps are often made of synthetic resin and are molded in molds because they are suitable for sealing when threadedly engage with the container body and for mass production.

On the other hand, in recent years, films formed by laminating various thin films have been used to prevent deterioration of ingredients contained in the contents due to oxidation or the like. Some films may be difficult to break through with the tip of a resin dispensing cylinder. Even if a cutter is provided on the peripheral portion of the tip of the dispensing cylinder to break through the film, penetration into the film or cutting of the film may not proceed easily depending on the shape of the cutter, making it difficult to allow the contents to be dispensed.

Therefore, it is important to develop an ejection cap capable of smoothly and reliably breaking through the film that closes the mouth part of the container body and allowing the contents of the container to be easily dispensed.

Patent Document 1: Japanese Unexamined Patent Application, Publication No. H10-230960

DISCLOSURE OF THE INVENTION

Problems to be Solved by the Invention

It is an object of the present invention to provide an ejection cap capable of smoothly and reliably breaking through a film that closes a mouth part of a container body and allowing the contents of the container to be easily dispensed.

Means for Solving the Problems

To achieve the object, the inventors have studied and have reached the present invention after the following discovery: a film can be broken through smoothly and reliably by providing a cutter that has a cutout on a side surface on a side opposite to a direction of rotation in which a cap threadedly engages, at a tip of a dispensing cylinder that extends from a lower surface of a top plate of the cap.

That is, the present invention relates to an ejection cap for threadedly engaging with a mouth part of a container body closed by a film. The ejection cap includes a substantially cylindrical dispensing cylinder that extends downward from a lower surface of a top plate. The substantially cylindrical dispensing cylinder is configured to penetrate the film to allow a content of the container body to be dispensed. The dispensing cylinder includes an asymmetric cutter on a substantially peripheral portion of a tip thereof. The asymmetric cutter has a cutout on a side surface on a side opposite to a direction of rotation for threadedly engaging.

Further, the present invention relates to an ejection cap in which a plurality of cutters having different tip height positions are provided on the substantially peripheral portion of the tip of the dispensing cylinder.

Further, the present invention relates to an ejection cap, in which, when one of the cutters on the substantially peripheral portion of the tip of the dispensing cylinder is arranged at a central angle θ (degrees) of a circle to a reference cutter of the cutters, a tip height position of the cutter arranged is higher than that of the reference cutter by ΔH defined by the following expression:

$$0<\Delta H\leq L\times\theta/360$$

in which L represents lead length of a spiral of the ejection cap that threadedly engages with the mouth part of the container body.

Effects of the Invention

The ejection cap of the present invention is capable of smoothly and reliably breaking through the film that closes the mouth part of the container body and allowing the contents of the container to be easily dispensed.

BRIEF DESCRIPTION OF THE DRAWINGS

FIG. 2 is a diagram showing evaluation results of ejection caps;

FIG. 3 is a diagram showing placement examples of cutters;

PREFERRED MODE FOR CARRYING OUT THE INVENTION

An ejection cap of the present invention will now be described in detail. The connection or attachment of components of the present invention includes not only direct connection or the like, but also indirect connection or the like through another component. It includes any connection or attachment that maintains at a substantially constant level the relative positional relationship between the attachment sites of the two target components unless otherwise specified.

Figure 1:
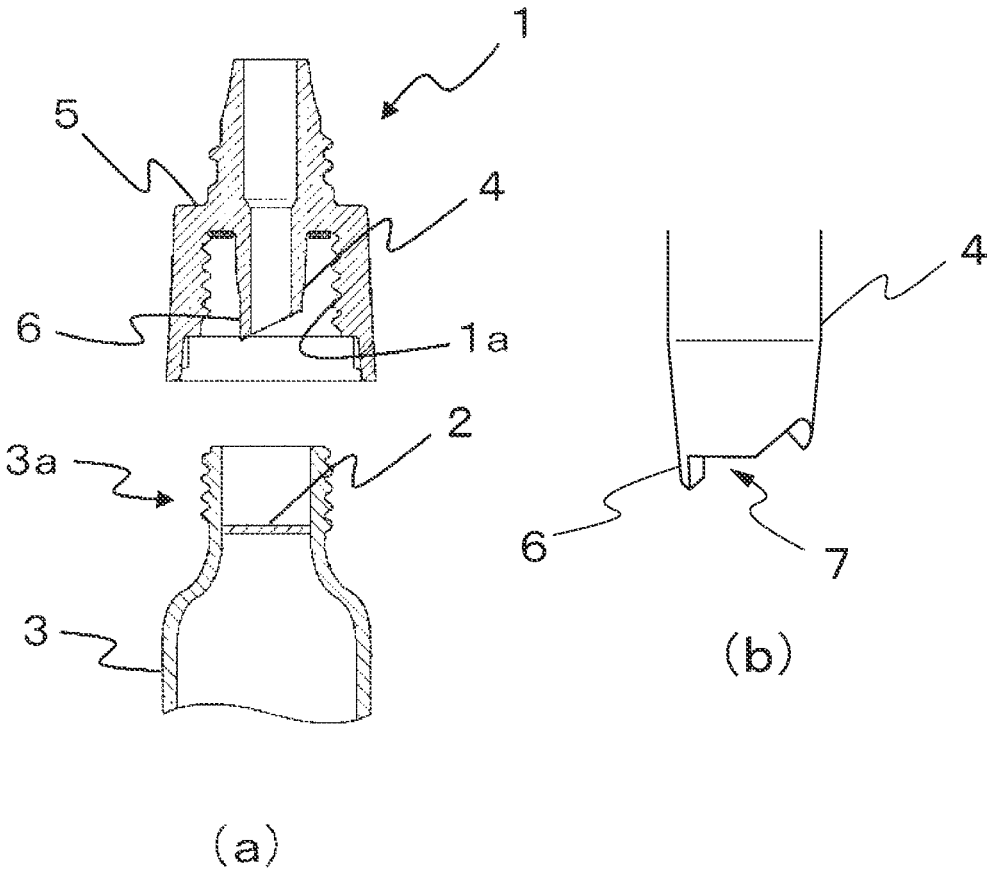
FIG. 1 is a diagram showing the structure of an ejection cap ((a) sectional view of the ejection cap, (b) external view of a dispensing cylinder)

As shown in FIG. 1, an ejection cap (1) of the present invention threadedly engages with a mouth part (3*a*) of a container body (3) closed by a film (2). The ejection cap (1) includes a substantially cylindrical dispensing cylinder (4) that extends downward from a lower surface of a top plate (5) and is configured to penetrate the film to allow a content to be dispensed. The dispensing cylinder includes an asymmetric cutter (6) on a substantially peripheral portion of a tip thereof. The asymmetric cutter has a cutout (7) on a side surface on a side opposite to a direction of rotation for threadedly engaging.

The film (2) is used to keep the contents of the container sealed in order to prevent oxidation or other deterioration of the ingredients contained in the contents of the container during the period from the completion of a product until a user begins to use it. As long as the film has such functions, the material, shape, attachment position, and so on of the film are not limited. FIG. 1 shows an example of the film attached to the inside of the mouth part of the container body. For example, the tip of the mouth part of the container body can be heated to fuse the resin to form a thin film and thus seal the contents. Therefore, the film refers to a film that has a thickness that allows the tip of the dispensing cylinder of the ejection cap to pierce and penetrate the film. All such films can be used as the film through which the ejection cap of the present invention penetrates.

An inner surface of a side wall (la) of the ejection cap (1) and the mouth part (3*a*) of the container body (3) are each provided with a spiral. While rotating the ejection cap in a horizontal direction, the spirals of the two are threadedly engaged to attach the ejection cap to the container body.

The substantially cylindrical dispensing cylinder (4), which communicates with the outside, extends downward from the lower surface of the top plate (5) of the ejection cap. When the ejection cap threadedly engages with the mouth part of the container body, the dispensing cylinder descends and penetrates the film.

The dispensing cylinder is not limited to a strictly cylindrical shape because it is sufficient that the dispensing cylinder can smoothly penetrate the film by the horizontal rotation of the ejection cap. Any cylindrical shape that is rotationally symmetrical around the axis center, such as elliptical or polygonal cylindrical shapes, can be used.

The asymmetric cutter having the cutout (7) on the side surface on the side opposite to the direction of rotation for threadedly engaging is provided on the substantially peripheral portion of the tip of the dispensing cylinder (4). FIG. 1 shows an example in which the horizontal rotation of the ejection cap during threadedly engaging is clockwise when viewed from above. In this example, a cutout is provided on the right side surface of the cutter, which corresponds to the side surface on the side opposite to the direction of rotation for threadedly engaging.

This cutout allows the tip of the cutter to have a smaller angle, making it easier to pierce and penetrate the film. While the cutout is provided on the side surface on the side opposite to the direction of rotation, if the cutout were to be provided on a side surface in the direction of rotation, the vertical section of the cutout would provide resistance, making it difficult for the cutter to proceed while cutting through the film. Thus, the task of opening cannot be performed smoothly.

FIG. 2 shows the evaluation results of ejection caps with different numbers and shapes of cutters. The cutters each having a cutout on a side surface on a side opposite to the direction of rotation showed good results in all evaluation items. The evaluation item, film perforability, refers to the ease with which the dispensing cylinder can penetrate the film by piercing and cutting through the film. The results of the evaluation are indicated as ⊙ (bullseye symbol): very good, o (circle symbol): good, and x (cross symbol): poor. The rotational torque refers to the degree of force required to rotate the ejection cap, and the results of the evaluation are indicated as ⊙ (bullseye symbol): rotational torque is constant, o (circle symbol): rotational torque is almost constant, and x (cross symbol): rotational torque is uneven.

A plurality of cutters having different tip height positions can be provided on the substantially peripheral portion of the tip of the dispensing cylinder. By providing a plurality of cutters, it is possible to reliably pierce and penetrate any film. In addition, by providing a plurality of cutters having different heights, the position at which each cutter pierces the film can be adjusted. This allows a part of the film to remain uncut and connected to the surrounding area, and prevents a film piece from being cut around its entire periphery and hence from falling into the contents and then getting into the communicating hole of the dispensing cylinder during use, making it impossible to allow the contents to be dispensed.

FIG. 3 shows examples of a plurality of cutters attached. In Test Examples 1, 3, and 4, in which the tip height positions of the main and sub cutters were different, it was confirmed that a part of the film that was not cut and was connected to the surrounding area could be left, thus preventing a film piece from falling into the contents.

When the sub cutter is arranged at the central angle θ (degrees) of the circle to the main cutter, which is the reference, it is preferable that the tip height position of the sub cutter is higher than that of the main cutter by ΔH defined by the following expression:

$$0<\Delta H\leq L\times\theta/360$$

in which L represents lead length of the spiral of the ejection cap that threadedly engages with the mouth part of the container body.

Figure 4:
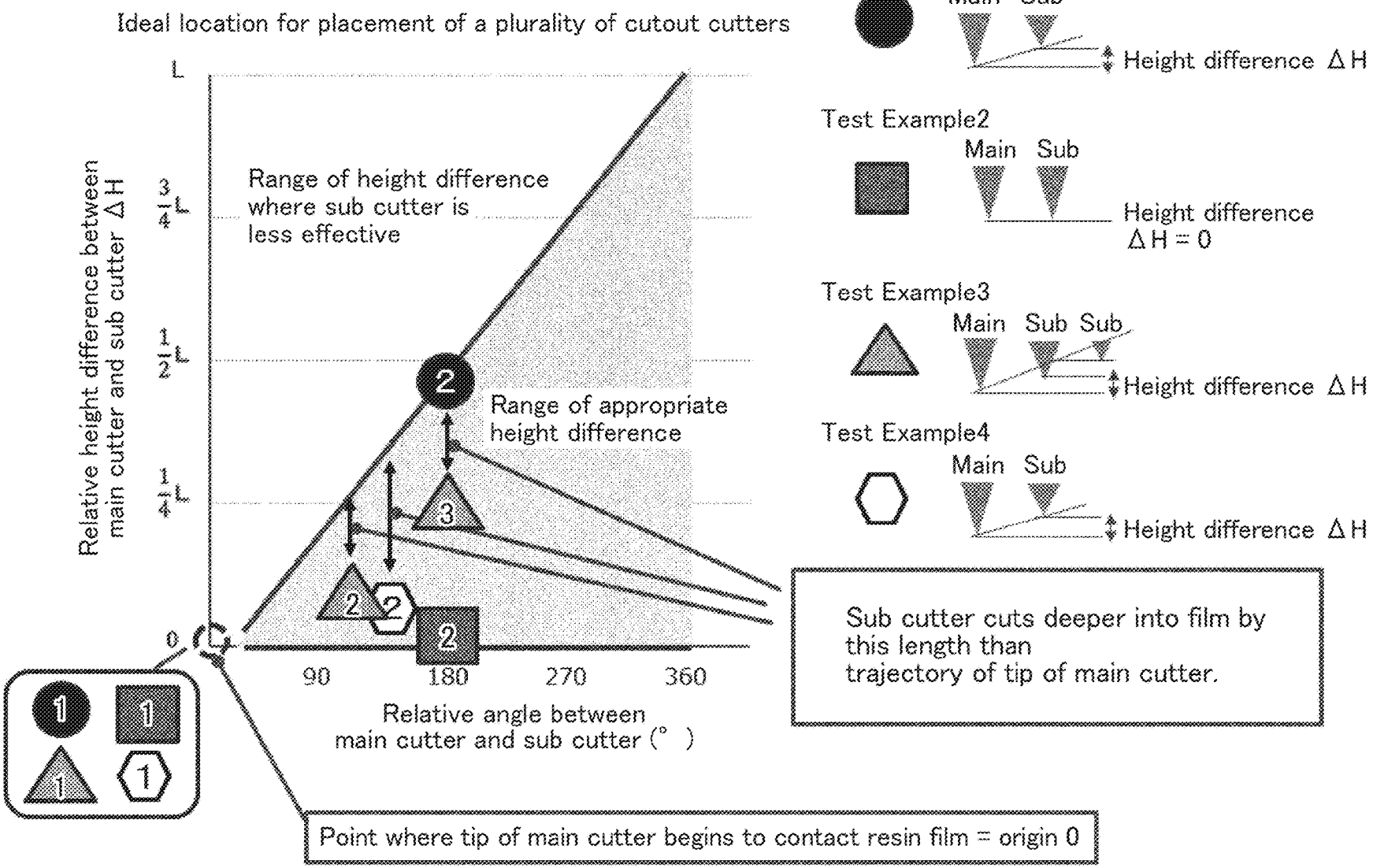
FIG. 4 is a diagram showing the relationship between cutter placement and height.

The relative position of the sub cutter to the reference main cutter can be specified by the central angle θ (degrees) of the circle (FIG. 3). By using such a central angle θ (degrees) and the lead length L (the distance the spiral moves in the direction of the axis of rotation by one rotation) of the spiral of the ejection cap that threadedly engages with the mouth part of the container body, it is possible to schematically show how far above the tip height position of the reference main cutter the tip height position of the sub cutter should be positioned (FIG. 4). As shown in FIG. 4, for example, when the position of the sub cutter to be arranged is set at a central angle of 180 degrees to the reference main cutter (Test Example 1), it is preferable that the difference (ΔH) between the tip height position of the sub cutter and that of the main cutter is ½ or less of the lead length (L) of the spiral. By arranging the tip height position of the sub cutter in this way, when the ejection cap rotates, the sub cutter proceeds at a deeper position than the track where the main cutter pierces and cuts through the film, thus ensuring that the film is cut.

Figure 5:
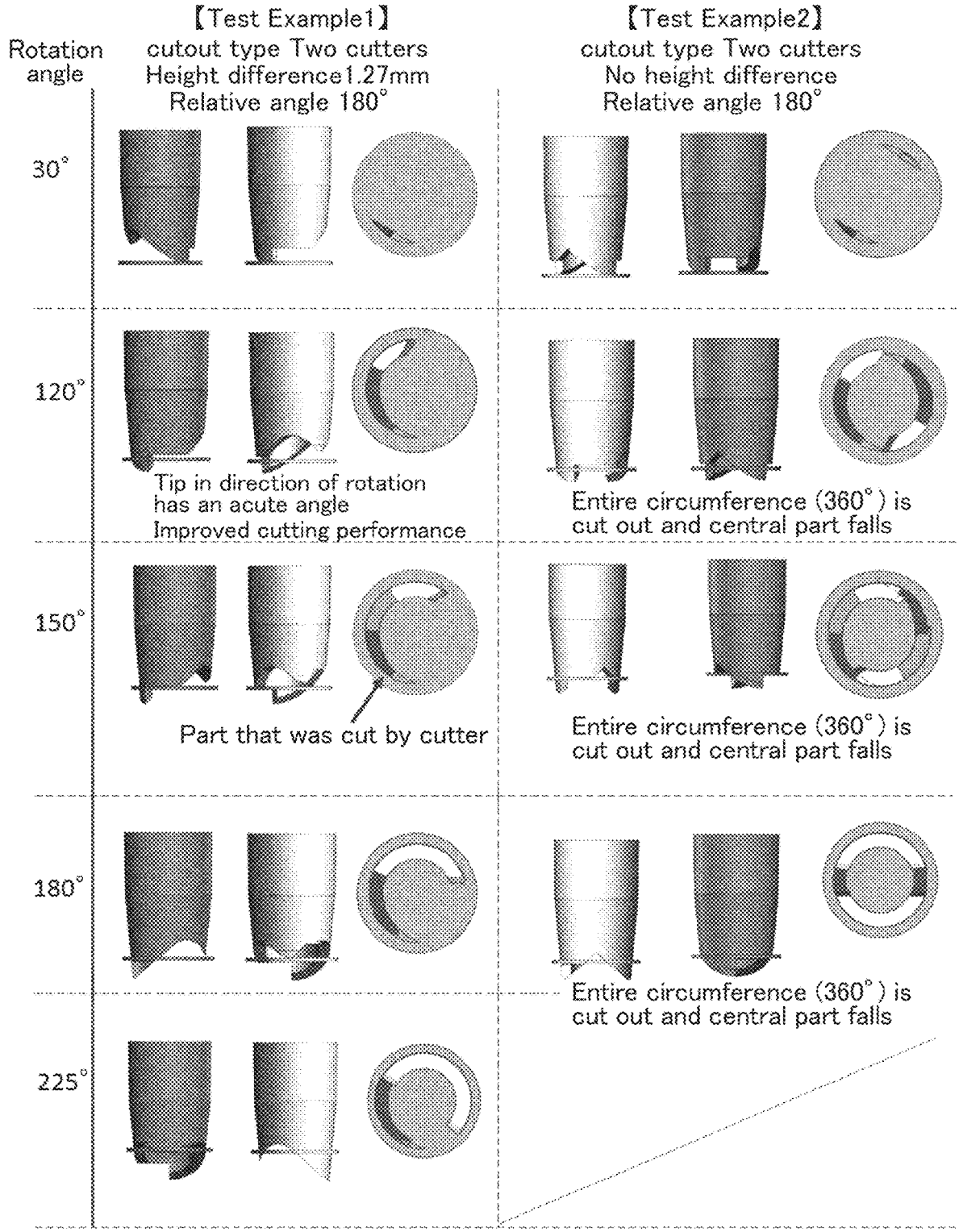
FIG. 5 is a schematic diagram showing cutters breaking through a film.

On the other hand, as shown in Test Example 2, if the tip height position of the sub cutter is the same as that of the main cutter (ΔH=0), as shown in FIG. 5, the sub cutter proceeds in the same way as the main cutter at a rotationally symmetrical position. Thus, when the main cutter rotates 180 degrees, the sub cutter rotates 180 degrees in the same way, and the film is cut around the entire periphery of a film piece, causing the film piece to fall into the contents.

Figure 6:
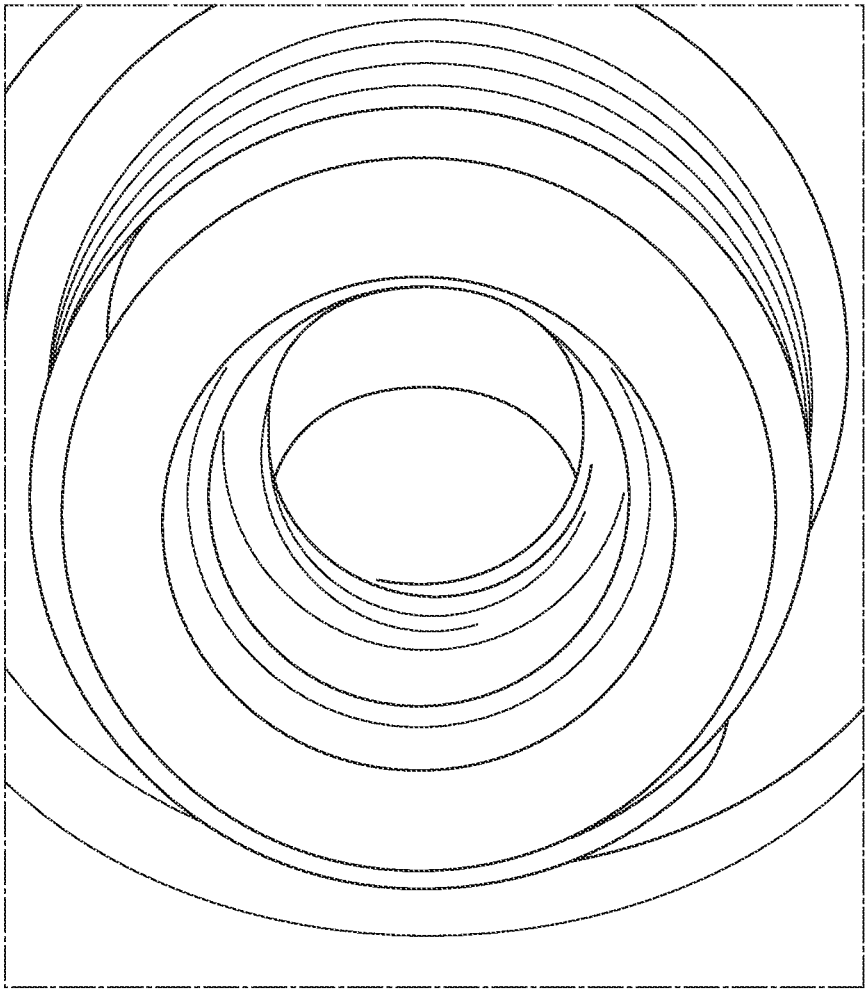
FIG. 6 is a diagram showing an opening of a film (substitute photo for the drawing).

FIG. 6 shows the state of the opening of the film after penetration in Test Example 1. It is confirmed that the cutter cut the film reliably while leaving the part connected to the surrounding area.

EXPLANATION OF REFERENCE NUMERALS

1 ejection cap
1*a* inner surface of side wall
2 film
3 container body
3*a* mouth part
4 dispensing cylinder
5 top plate

6 cutter
6*a* main cutter
6*b* sub cutter
6*c* sub cutter
7 cutout
7*a* cutout
7*b* cutout
7*c* cutout

The invention claimed is:

1. An ejection cap for threadedly engaging with a mouth part of a container body closed by a film, the ejection cap comprising:

a substantially cylindrical dispensing cylinder that extends downward from a lower surface of a top plate, the substantially cylindrical dispensing cylinder being configured to penetrate the film to allow a content of the container body to be dispensed, the dispensing cylinder comprising an asymmetric cutter on a substantially peripheral portion of a tip thereof, the asymmetric cutter having a cutout on a side surface on a side opposite to a direction of rotation for threadedly engaging.

2. The ejection cap according to claim 1, wherein a plurality of cutters having different tip height positions are provided on the substantially peripheral portion of the tip of the dispensing cylinder.

3. The ejection cap according to claim 2, wherein, when one of the cutters on the substantially peripheral portion of the tip of the dispensing cylinder is arranged at a central angle θ (degrees) of a circle to a reference cutter of the cutters, a tip height position of the cutter arranged is higher than that of the reference cutter by ΔH defined by the following expression:

$$0<\Delta H\leq L\times\theta/360$$

wherein L represents lead length of a spiral of the ejection cap that threadedly engages with the mouth part of the container body.

* * * * *